US007109645B2

(12) United States Patent
Suzuki et al.

(10) Patent No.: US 7,109,645 B2
(45) Date of Patent: Sep. 19, 2006

(54) SPARK PLUG

(75) Inventors: Hirofumi Suzuki, Kuwana (JP); Seiji Amakusa, Kasugai (JP)

(73) Assignee: Denso Corporation, (JP)

( * ) Notice: Subject to any disclaimer, the term of this patent is extended or adjusted under 35 U.S.C. 154(b) by 0 days.

(21) Appl. No.: 11/002,443

(22) Filed: Dec. 3, 2004

(65) Prior Publication Data

US 2005/0127808 A1 Jun. 16, 2005

(30) Foreign Application Priority Data

Dec. 10, 2003 (JP) ..... 2003-412041
Sep. 2, 2004 (JP) ..... 2004-255814

(51) Int. Cl.
*H01T 13/00* (2006.01)

(52) U.S. Cl. ..... 313/118; 313/135; 313/144; 123/169 R

(58) Field of Classification Search ..... 313/118, 313/141, 143, 144, 135; 123/169 EL, 169 C, 123/169 CB
See application file for complete search history.

(56) References Cited

U.S. PATENT DOCUMENTS 6,236,148 B1 5/2001 Nasu et al. ..... 313/141

FOREIGN PATENT DOCUMENTS

JP 2000-252042 9/2000

*Primary Examiner*—Ashok Patel
*Assistant Examiner*—Anthony Canning
(74) *Attorney, Agent, or Firm*—Nixon & Vanderhye PC

(57) ABSTRACT

A spark plug includes a metallic housing, an insulator fixed in the metallic housing, a center electrode fixed in the insulator, a ground electrode opposed to the center electrode via a spark discharge gap, and a protective coat formed on the surfaces of a metallic housing and a gasket. The protective coat includes a galvanized film formed on the surfaces of the metallic housing and the gasket and a chromate film successively laminated on the galvanized film. The chromate film is hexavalent chromium-free and contains trivalent chromium as a major component. The chromate film has a film thickness not smaller than 0.05 μm and not greater than 0.18 μm, and the chromate film contains a metallic component which is robust against oxidation compared with zinc. Furthermore, the chromate film has a film hardness equal to or less than 1 GPa in the temperature range from a room temperature to 180° C.

8 Claims, 7 Drawing Sheets

SPARK PLUG

CROSS-REFERENCE TO RELATED APPLICATION

This application is based upon and claims the benefit of priority of the Japanese Patent Application No. 2003-412041 filed on Dec. 10, 2003 and the Japanese Patent Application No. 2004-255814 filed on Sep. 2, 2004 so that the descriptions of which are incorporated herein by reference.

BACKGROUND OF THE INVENTION

The present invention relates to a spark plug including a protective coat formed on a surface of a metallic member, according to which the protective coat includes a galvanized film formed on the surface of this metallic member and a hexavalent chromium-free chromate film is successively laminated on this galvanized film.

In general, the spark plug includes a metallic housing, an insulator fixed in the metallic housing, a center electrode fixed in the insulator, and a ground electrode opposed to the center electrode via a spark discharge gap.

According to this spark plug, a corrosion resisting protective coat is formed on a surface of a metallic member, such as a metallic housing or a gasket provided around the outer surface of this metallic housing (for example, refer to the Japanese Patent Application Laid-open No. 2000-252042 corresponding to the U.S. Pat. No. 6,236,148.

This protective coat includes a galvanized film provided on the surface of the metallic member and a chromate film successively laminated on the galvanized film. The chromate film is hexavalent chromium-free and contains trivalent chromium as a major component.

This chromate film is a replacement for a conventionally used chromate film containing hexavalent chromium which is known as a substance giving adverse influence to the environment.

According to this protective coat, the chromate film has a sufficient film thickness of 0.2 μm to 0.5 μm to assure excellent corrosion resistance against acid. Furthermore, this chromate film contains substantially no hexavalent chromium and is preferable in view of protection of the environment.

However, according to the inventors of this invention, it is experimentally confirmed that a conventional protective coat is subjected to exfoliations of the chromate film at a tightening screwed portion of the metallic housing during an installation work because the chromate film has a large film thickness of 0.2 μm to 0.5 μm.

Furthermore, a gasket has a folded shape so that it can be fitted into a proximal end of the tightening screwed portion around an outer cylindrical surface of the metallic housing. As the gasket is subjected to a significant bending stress, the chromate film will cause exfoliations or cracks due to this bending stress. The corrosion resistance will be lessened.

To solve this problem, it may be possible to reduce the film thickness of the chromate film so that exfoliations or cracks causing in the film under a bending stress or the like can be suppressed.

However, a thin chromate film will be relatively corrosive when it is damaged. Furthermore, there is the tendency that a hard chromate film causes exfoliations or cracks.

SUMMARY OF THE INVENTION

In view of the above-described problems, the present invention is applied to a spark plug having a protective coat which includes a galvanized film formed on a surface of a metallic member and a hexavalent chromium-free chromate film successively laminated on the galvanized film. The present invention has an object to assure sufficient corrosion resistance for the chromate film even if the thickness of this chromate film is reduced to eliminate exfoliations or cracks occurring in the chromate film under a bending stress or the like.

In order to accomplish the above and other related objects, the present invention provides a first spark plug including a metallic housing, an insulator fixed in the metallic housing, a center electrode fixed in the insulator, a ground electrode opposed to the center electrode via a spark discharge gap, and a protective coat formed on at least part of a surface of a metallic member. The protective coat of the first spark plug includes a galvanized film formed on the surface of the metallic member and a chromate film successively laminated on the galvanized film. The chromate film of the first spark plug is hexavalent chromium-free and contains trivalent chromium as a major component. Furthermore, the first spark plug of the present invention is characterized in that the chromate film has a film thickness not smaller than 0.05 μm and not greater than 0.18 μm, and the chromate film contains a metallic component which is robust against oxidation compared with zinc.

First, according to the first spark plug of the present invention, the film thickness of the chromate film is not smaller than 0.05 μm and not greater than 0.18 μm. Thus, the chromate film of the first spark plug is thin compared with a conventional chromate film, and is accordingly capable of suppressing generation of exfoliations or cracks when a bending stress or the like acts on this film.

Furthermore, if the protective coat is damaged due to exfoliations or cracks, the protective coat may have an opened hole though which the surface of a metallic member is exposed. However, in such a case, according to the first spark plug of the present invention, the metallic component being robust against oxidation can react with zinc and accordingly can form or reconstruct a film as a reactant. In other words, the protective coat of the first spark plug according to the present invention has a self-repair function in its capability of reproducing a protective film.

If the film thickness of the chromate film is greater than 0.18 μm, the chromate film will be excessively thick. Accordingly, many exfoliations or cracks will appear on the film when the film is subjected to a bending stress or the like.

On the other hand, if the film thickness of the chromate film is less than 0.05 μm, the chromate film will be excessively thin and accordingly too small in total amount to satisfactorily obtain the above-described film reproduction effects.

Namely, according to the first spark plug of the present invention, the film thickness of the chromate film is set to a value not smaller than 0.05 μm and not greater than 0.18 μm. This setting is effective in suppressing exfoliations or cracks occurring in the film due to a bending stress or the like. Even if the protective coat is damaged by the exfoliations or cracks, the metallic component robust against oxidation compared with zinc can reproduce or reconstruct a film. The inventors of this invention have experimentally confirmed this mechanism as later described with reference to FIG. 8.

Accordingly, the present invention is applicable to a spark plug having the protective coat which includes the galvanized film formed on the surface of the metallic member and the hexavalent chromium-free chromate film successively laminated on the galvanized film. The present invention can assure satisfactory corrosion resistance for the chromate film even if the thickness of this chromate film is reduced to eliminate exfoliations or cracks occurring in the chromate film under a bending stress or the like.

In this case, according to the first spark plug of the present invention, it is preferable that metallic component is at least one component selected from the group consisting of cobalt, nickel, molybdenum, manganese, and lanthanoids.

Furthermore, according to the first spark plug of the present invention, it is preferable that the metallic component is cobalt and a weight ratio Co/Cr is not smaller than 0.05 and not greater than 0.4, wherein the weight ratio Co/Cr represents a ratio of cobalt elements to chromium elements contained in the chromate film.

The present invention is based on experimental demonstration (refer to experimental data shown in FIG. 9). When the weight ratio Co/Cr in the chromate film is not smaller than 0.05 and not greater than 0.4, it is possible to obtain practically sufficient corrosion resistance for the chromate film having the film thickness not smaller than 0.05 μm and not greater than 0.18 μm.

If the weight ratio Co/Cr in the chromate film is smaller than 0.05, the amount of Co contributing to the reproduction of the film will be too small to satisfactorily obtain the above-described film reproduction effects.

On the other hand, if the weight ratio Co/Cr in the chromate film is larger than 0.4, the Co amount will be excessively large and accordingly the chromate film will be undesirably hard. From the fact that a thick film tends to cause many exfoliations or cracks, the above-described film reproduction effects will be canceled.

Furthermore, the present invention provided a second spark plug includes a metallic housing, an insulator fixed in the metallic housing, a center electrode fixed in the insulator, a ground electrode opposed to the center electrode via a spark discharge gap, and a protective coat formed on a surface of a metallic member. The protective coat of the second spark plug includes a galvanized film formed on the surface of the metallic member and a chromate film successively laminated on the galvanized film. The chromate film of the second spark plug is hexavalent chromium-free and contains trivalent chromium as a major component. Furthermore, the second spark plug of the present invention is characterized in that the chromate film has a film thickness not smaller than 0.05 μm and not greater than 0.18 μm, and the chromate film has a film hardness equal to or less than 1 GPa at a room temperature.

According to the second spark plug of the present invention, the film thickness of the chromate film is not smaller than 0.05 μm and not greater than 0.18 μm. Thus, the chromate film of the second spark plug of this invention is thin compared with a conventional chromate film. Furthermore, according to the second spark plug of the present invention, the film hardness at the room temperature is equal to or less than 1 GPa. Accordingly, the chromate film of the second spark plug according to this invention is soft. Accordingly, it becomes possible to suppress generation of exfoliations or cracks when a bending stress or the like acts on this film.

Accordingly, the present invention is applicable to a spark plug having the protective coat which includes the galvanized film formed on the surface of the metallic member and the hexavalent chromium-free chromate film successively laminated on the galvanized film. The second spark plug according to the present invention can assure satisfactory corrosion resistance for the chromate film even if the thickness of this chromate film is reduced to eliminate exfoliations or cracks occurring in the chromate film under a bending stress or the like.

In this case, according to the second spark plug of the present invention, it is preferable that the chromate film has the film hardness equal to or less than 1 GPa in the temperature range from the room temperature to 180° C.

According to this arrangement, a thermal treatment temperature for the chromate film can be set to a higher value. Thus, the chromate film can possess sufficient corrosion resistance when the spark plug is installed in an engine, in which the temperature of the chromate film increases up to approximately 180° C.

Furthermore, according to the above-described first or second spark plug of the present invention, it is preferable that the metallic member is a gasket provided around an outer surface of the metallic housing.

From its structural features, the gasket is subjected to a large bending stress. Thus, it is effective to adapt the above-described chromate film arrangement of the present invention.

Furthermore, according to above-described first or second spark plug of the present invention, it is preferable that the metallic member is the metallic housing. As easily understood, the metallic housing can be designated as the metallic member of the present invention.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Hereinafter, preferred embodiments of the present invention will be explained hereinafter with reference to attached drawings.

Figure 1:
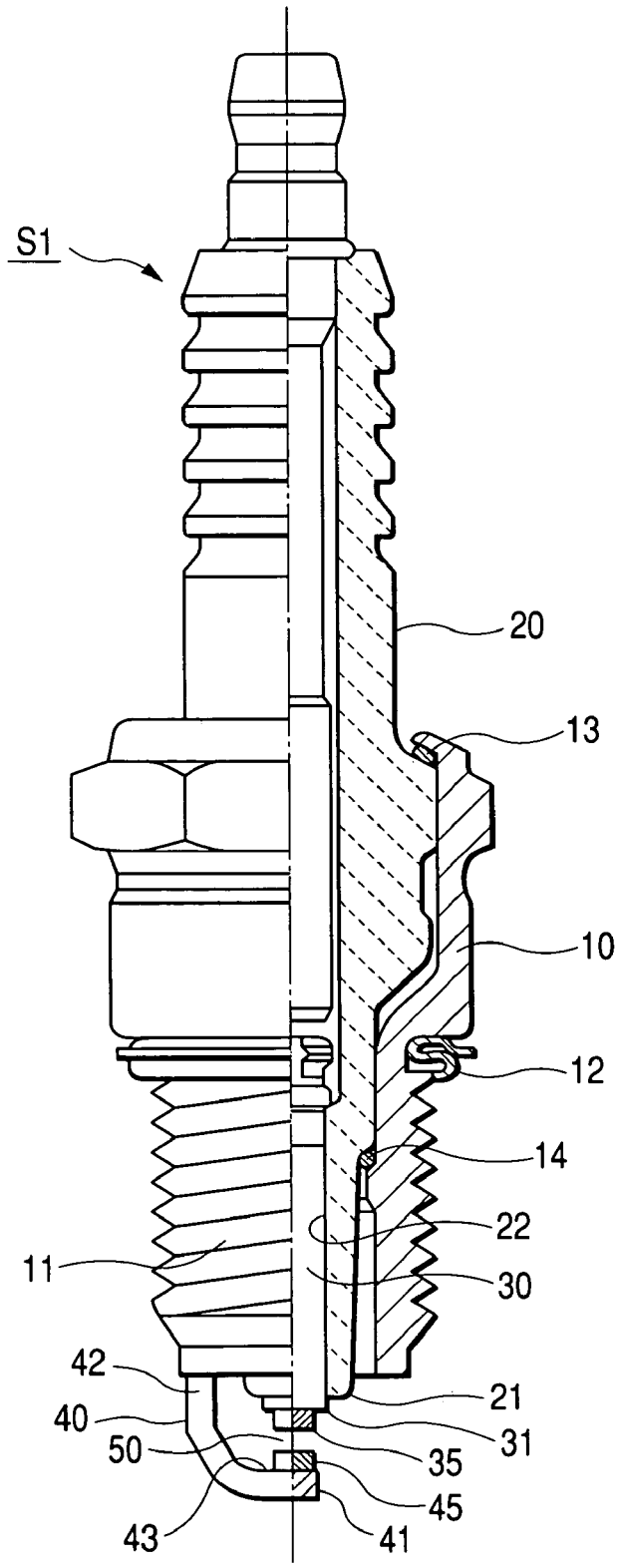
FIG. 1 is a half-sectional view showing an overall arrangement of a spark plug in accordance with a preferred embodiment of the present invention.

FIG. 1 is a half-sectional view showing an overall arrangement of spark plug S1 in accordance with a preferred embodiment of the present invention.

This spark plug S1 is usable as an ignition plug for an automotive vehicle, which is inserted and fixed in a screw hole K2 provided in an engine head K1 (refer to FIG. 2) defining a combustion chamber of this engine.

Figure 2:
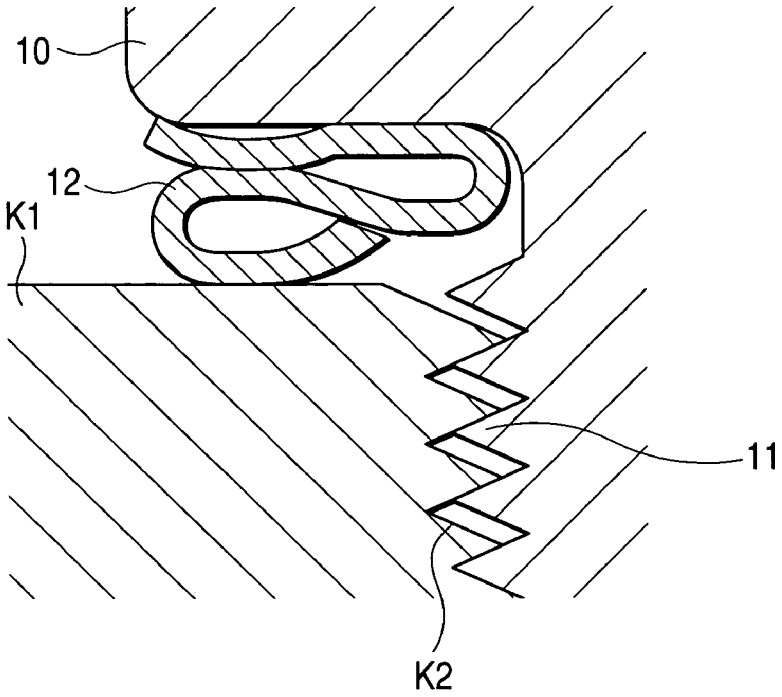
FIG. 2 is a schematic cross-sectional view showing a gasket and its vicinity in a condition that the spark plug shown in FIG. 1 is fixed to an engine head.

FIG. 2 is a schematic cross-sectional view showing a gasket 12 and its vicinity in a condition that the spark plug S1 is fixed to the engine head K1.

The spark plug S1 has a cylindrical metallic housing 10. The metallic housing 10 can be formed by cutting and processing an electrically conductive steel member (e.g. low-carbon steel or the like) or the like. The metallic housing 10 has a tightening screwed portion 11 formed on an outer cylindrical surface thereof. The metallic housing 10 is fixed to an engine block (not shown) via the tightening screwed portion 11.

Furthermore, the gasket 12 is fitted to the proximal end of the tightening screwed portion 11 formed on the outer cylindrical surface of this metallic housing 10.

The gasket 12 is a ring-shaped member formed by bending a carbon steel material or a comparable metallic plate material. As shown in FIG. 2, the metallic housing 10 is tightened into the screw hole K2 of the engine head K1. The gasket 12 has the capability of sealing the clearance between the metallic housing 10 and the engine block K1.

An insulator 20, made of alumina ceramic ($Al_2O_3$) or the like, is fixed in the metallic housing 10. A distal end 21 of insulator 20 protrudes from one end of the metallic housing 10.

A center electrode 30 is fixed in an axial hole 22 of the insulator 20. The center electrode 30 is electrically insulated from the metallic housing 10.

The center electrode 30 has a cylindrical body and consists of an inner member and an outer member. The inner member of center electrode 30 is made of a metallic material, such as Cu, which has excellent thermal conductivity. The outer member of center electrode 30 is made of a metallic material, such as a Ni-based alloy, which has excellent heat durability and corrosion resistance. As shown in FIG. 1, a distal end surface 31 of center electrode 30 is positioned outside the distal end 21 of insulator 20.

On the other hand, the ground electrode 40 is constituted by a rectangular rod which is, for example, made of a Ni-based alloy containing Ni as a major component. The ground electrode 40 is welded at its proximal end 42 to one end of the metallic housing 10. The ground electrode 40 is bent at its intermediate portion to have a substantially L-shaped configuration. The ground electrode 40 has an inside surface 43 (hereinafter, referred to as distal end side surface) at its distal end 41. The distal end side surface 43 is opposed to the distal end surface 31 of center electrode 30 via a discharge gap 50.

As shown in FIG. 1, noble metallic firing tips 35 and 45 are bonded to these opposed surfaces 31 and 43 of the center and ground electrodes 30 and 40 by laser welding or resistance welding, or the like.

Each of these firing tips 35 and 45 has a cylindrical body with one end-surface bonded to a corresponding one of the electrodes 30 and 40 by welding or the like. The discharge gap 50 represents a clearance between distal end surfaces of these firing tips 35 and 45.

These firing tips 35 and 45 are made of a noble metallic material, such as Pt, a Pt alloy, Ir, or an Ir alloy. According to this embodiment, both firing tips 35 and 45 are Ir alloy firing tips containing Ir as a major component and at least one kind of additive component selected from the group consisting of Rh, Pt, Ru, Pd, and W. Thus, each of the firing tips 35 and 45 has a higher melting point and excellent wear-resistive properties.

According to this embodiment, a protective coat 15 (refer to FIG. 3) is formed on part of the surface of a metallic member, i.e. on the surfaces of the metallic housing 10 and the gasket 12, of the above-described spark plug S1. The protective coat 15 has appropriate corrosion resistance against water content and chlorine in the air.

Figure 3:
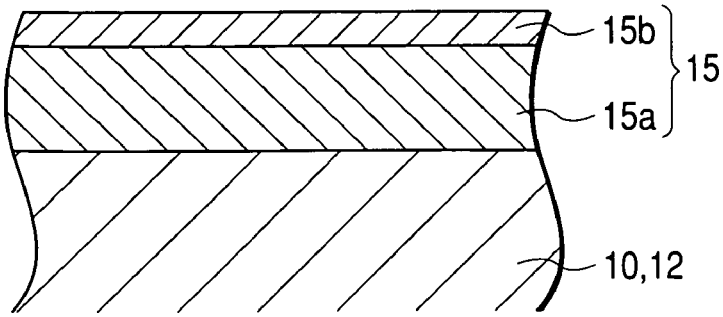
FIG. 3 is a cross-sectional view showing the arrangement of a protective coat provided on a metallic member of the spark plug shown in FIG. 1.

FIG. 3 is a cross-sectional view showing the arrangement of the protective coat 15. As shown in FIG. 3, the protective coat 15 consists of a galvanized film 15*a* provided on the surface of the metallic member 10 or 12 and a chromate film 15*b* successively laminated on the galvanized film 15*a*. The chromate film 15*b* is hexavalent chromium-free and contains trivalent chromium as a major component.

The galvanized film 15*a* is, for example, a plated film which has a film thickness not less than 2 μm and not greater than 30 μm and is made of zinc or a zinc alloy. The galvanized film 15*a* can be formed by an ordinary electric plating method. For example, the zinc plating will deposit on the metallic member 10 or 12 in an acid bath such as sulfate bath, ammonium bath, and kalium bath, or in an alkali bath such as alkali cyanide-free bath, and alkali cyanide bath.

Furthermore, the chromate film 15*b* has a film thickness not smaller than 0.05 μm and not greater than 0.18 μm. The chromate film 15*b* contains a metallic component which is robust against oxidation compared with zinc. The chromate film 15*b* can be formed by the method using a treatment solution for forming a trivalent chromate film.

More specifically, the metallic component contained in the chromate film 15*b* is at least one component selected from the group consisting of cobalt (Co), nickel (Ni), molybdenum (Mo), manganese (Mn), and lanthanoids.

The lanthanoids is a general term representing the elements of atomic numbers 57 to 71 in the periodic table; namely, lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu).

According to the protective coat 15 according to this embodiment, the metallic component contained in the chromate film 15*b* is bivalent cobalt and the weight ratio Co/Cr is not smaller than 0.05 and not greater than 0.4 where the weight ratio Co/Cr represents a weight ratio of cobalt elements to chromium elements contained in the chromate film 15*b*.

According to this embodiment, in forming the protective coat 15, the galvanized film 15*a* is first formed on the surface of the metallic member 10 or 12. And then, the galvanized film 15*a* is exposed to a treatment solution containing trivalent chromium and cobalt ions to form the chromate film 15*b*. For example, the metallic member 10 or 12 is soaked in this treatment solution to form the chromate film 15*b*.

In preparing the treatment solution for forming the chromate film 15*b* according to this embodiment, any chromium compound containing trivalent chromium can be used as a source of trivalent chromium. It is preferable to use the chrome oxide salt such as chromium nitrate, chromium chloride, chromium sulfate, chromium phosphate, and chromium acetate. Alternatively, to obtain a source of trivalent chromium, it will be possible to use an appropriate reducing agent to reduce the hexavalent chromium, such as chromate or dichromate, into trivalent chromium. Furthermore, regarding the source of trivalent chromium, it is possible to use one or two kinds of above-described sources.

Furthermore, any cobalt compound containing bivalent or trivalent cobalt can be used as a source of cobalt ions. It is preferable to use cobalt nitrate, sulfate cobalt, and cobalt chloride.

According to this embodiment, the solution containing the source of trivalent chromium and the source of cobalt ions is prepared as the above-described treatment solution. In this case, the mixing ratio of the trivalent chromium source to the cobalt ion source is determined in such a manner that the weight ratio Co/Cr of cobalt elements to chromium elements can be set to a value not smaller than 0.05 and not greater than 0.4.

Then, the prepared treatment solution is used to apply the chromate treatment to the metallic housing 10 or to the gasket 12 to form the chromate film 15*b* according to this embodiment. Thus, the protective coat 15 is accomplished.

In manufacturing the gasket 12, a protective coat 15 is formed by galvanizing a plate material and applying a chromate treatment to the plate. Then, the plate is configured into a predetermined shape through appropriate bending processing. Accordingly, compared with the metallic housing 10, a large bending stress acts on the protective coat 15 of the gasket 12.

Alternatively, the gasket 12 can be manufactured by a different method. For example, after the bending processing is applied to a plate material, it is possible to carry out the galvanizing processing and the chromate processing to form the protective coat 15. However, even in this case, a significant stress is applied to the gasket in the final process of installing and fixing the spark plug into an engine.

Figure 4A:
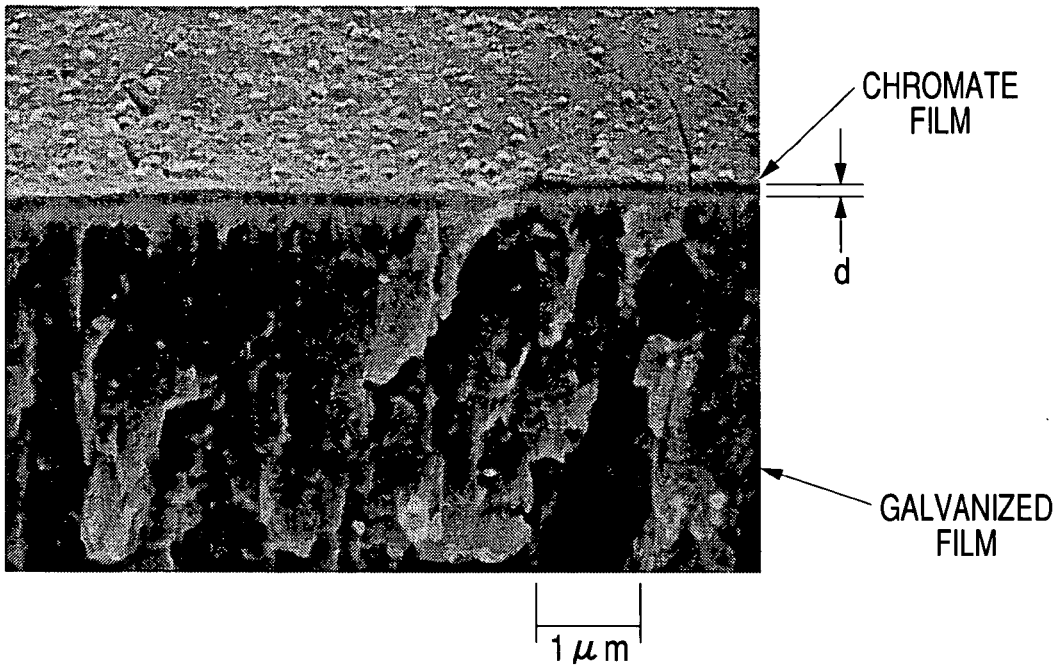
FIG. 4A is an electron microscopic photograph showing part of a cross section of the protective coat.
Figure 4B:
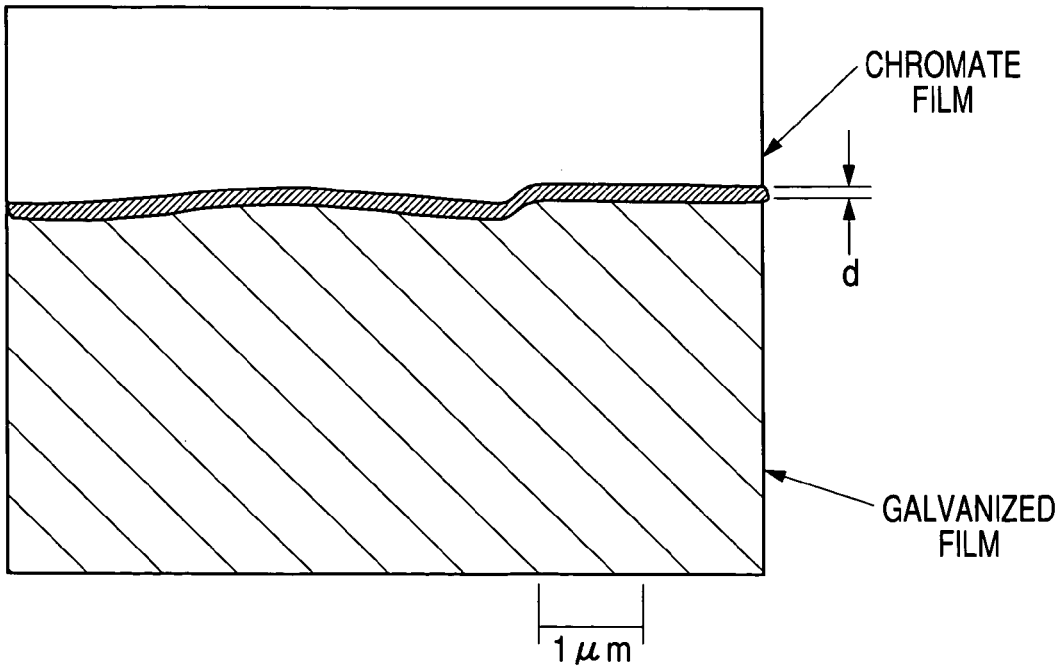
FIG. 4B is a partly cross-sectional view schematically illustrating the electron microscopic photograph shown in FIG. 4A.

FIG. 4A is an electron microscopic photograph showing part of a cross section of the protective coat 15 taken by a SEM (i.e. scanning electron microscope). FIG. 4B is a partly cross-sectional view schematically illustrating the electron microscopic photograph shown in FIG. 4A.

As shown in FIGS. 4A and 4B, the electron microscopic photograph clearly shows a cross section of chromate film 15*b* in the protective coat 15. According to this embodiment, the film thickness 'd' of the chromate film 15*b* can be measured based on the electron microscopic photograph. According to the example shown in FIGS. 4A and 4B, the chromate film 15*b* has the film thickness 'd' of 15 μm.

Regarding the film thickness of galvanized film 15*a*, it is possible to measure the film thickness by using a conventionally known fluorescent X-ray analysis.

As apparent from the foregoing description, this embodiment provides the spark plug S1 including the metallic housing 10, the insulator 20 fixed in the metallic housing 10, the center electrode 30 fixed in the insulator 20, and the ground electrode 40 opposed to the center electrode 30 via a spark discharge gap 50. The protective coat 15 is formed on at least part of a surface of the metallic member 10 or 12. The protective coat 15 consists of the galvanized film 15*a* formed on the surface of the metallic member and the chromate film 15*b* successively laminated on the galvanized film 15*a*. The chromate film 15*b* is hexavalent chromium-free and contains trivalent chromium as a major component. The spark plug S1 of this embodiment is characterized in that the chromate film 15*b* has a film thickness not smaller than 0.05 μm and not greater than 0.18 μm, and the chromate film 15*b* contains a metallic component which is robust against oxidation compared with zinc.

According to the spark plug S1 of this embodiment, the film thickness of the chromate film 15*b* is not smaller than 0.05 μm and not greater than 0.18 μm. Thus, the chromate film 15*b* of this embodiment is thin compared with a conventional chromate film, and is accordingly capable of suppressing generation of exfoliations or cracks when a bending stress or the like acts on this film.

Furthermore, if the protective coat 15 is damaged due to exfoliations or cracks, the protective coat 15 may have an opened hole though which the surface of the metallic member 10 or 12 is exposed. However, according to the spark plug S1 of this embodiment, even in such a case, the metallic component being robust against oxidation can react with zinc and accordingly can form or reconstruct a film as a reactant. In other words, the protective coat 15 of this embodiment has a self-repair function in its capability of reproducing a protective film.

Figure 5:
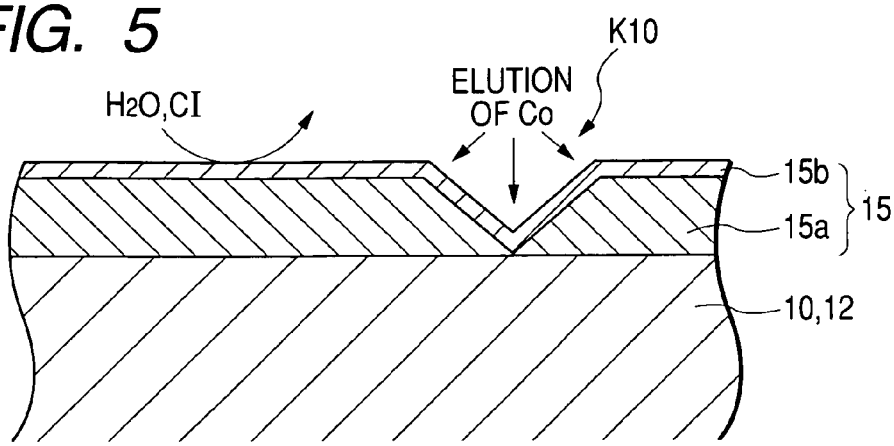
FIG. 5 is a cross-sectional view explaining the self-repair mechanism of the protective coat in a case that the metallic component is cobalt.

Hereinafter, with reference to FIG. 5, the self-repair function of the protective coat 15 will be explained in more detail. FIG. 5 is a view explaining the self-repair mechanism of the protective coat 15 in a case that the metallic component is cobalt.

According to the protective coat 15 of this embodiment, when the metallic component is cobalt, the chromate film 15*b* has the composition of $xCr_20_3.yCoOn.zH_2O$. In general, water ($H_2O$) and chlorine (Cl) residing in the air are the substances causing corrosion.

It is now supposed that the protective coat 15 is damaged due to exfoliations or cracks and has a hole, i.e. a defective portion k10, where the surface of metallic member 10 or 12 is exposed as shown in FIG. 5.

In this defective portion K10, cobalt (Co) elutes out of the chromate film 15*b* and reacts with zinc (Zn) according to the following reaction formula 1.

$$Zn+2Co^{3+}+4OH^{-}\rightarrow 2Co(OH)_2\downarrow+Zn^{2+} \quad (1)$$

Namely, cobalt (cobalt ion $Co^{3+}$) is easily reduced compared with zinc. Thus, cobalt (cobalt ion $Co^{3+}$) turns into $Co^{2+}$ to form a hydroxide. Meanwhile, zinc (Zn) is oxidized. As a result, zinc (Zn) turns into $Zn^{2+}$ ion. The reactant, i.e. cobalt hydroxide $2Co(OH)_2$, forms a film.

Accordingly, the surface of metallic member 10 or 12, which is to be exposed at the defective portion K10, can be covered by the cobalt hydroxide film. In other words, the cobalt hydroxide film blocks the external corrosion factors. Thus, corrosion of the metallic member 10 or 12 can be surely prevented. This is the mechanism of the self-repair function.

If the film thickness of the chromate film 15*b* is greater than 0.18 μm, the chromate film 15*b* will be too thick to suppress generation of exfoliations or cracks occurring under a bending stress or the like. Thus, the above-described film reproduction effects will be canceled.

On the other hand, if the film thickness of the chromate film 15*b* is less than 0.05 μm, the chromate film 15*b* will be too thin in thickness and small in amount to ensure the above-described film reproduction effects.

Namely, according to this embodiment, the film thickness of the chromate film 15*b* is set to a value not smaller than 0.05 μm and not greater than 0.18 μm. This setting is effective in suppressing exfoliations or cracks occurring in the film due to a bending stress or the like. Even if the protective coat 15 is damaged by the exfoliations or cracks, the metallic component robust against oxidation compared with zinc can reproduce a film.

The inventors of this invention have experimentally confirmed the above-described film reproduction effects. The following is one example of evaluation results.

Figure 6:
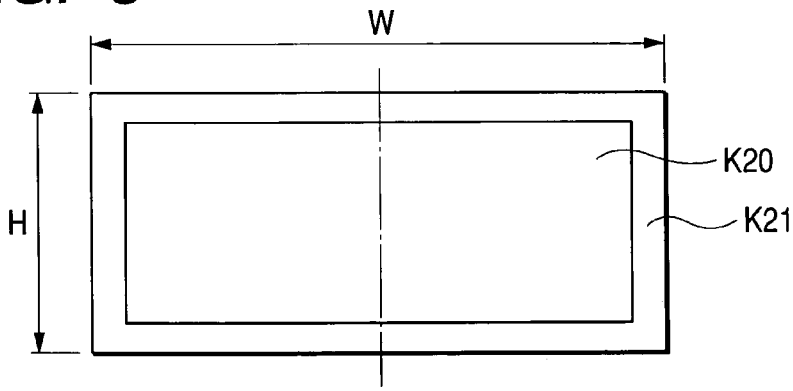
FIG. 6 is a plan view showing the arrangement of an evaluation sample used for evaluating film reproduction effects.
Figure 7A:
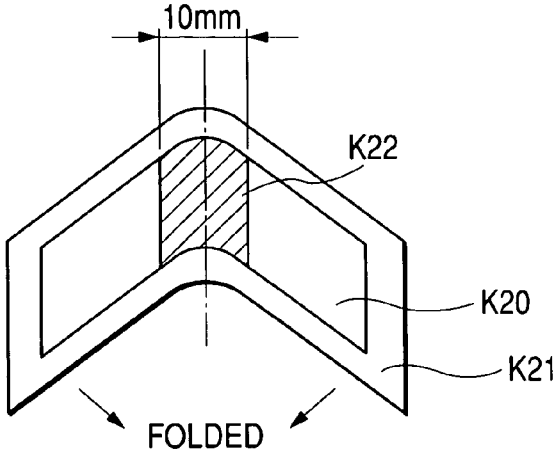
FIGS. 7A and 7B are views showing a practical method for evaluating film reproduction, in which the evaluation sample shown in FIG. 6 is used.
Figure 7B:
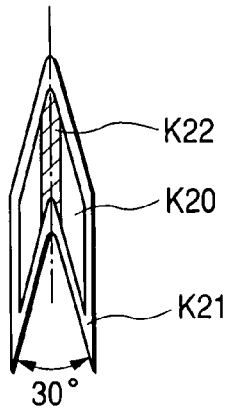

FIG. 6 is a plan view showing the arrangement of an evaluation sample used for evaluating film reproduction effects. FIGS. 7A and 7B are views explaining an evaluation method using the evaluation sample shown in FIG. 6.

A sample K20 shown in FIG. 6 is 50 mm in vertical size H, 100 mm in lateral size W and 0.4 mm in plate thickness. The sample K20 is a steel plate which is, for example, a SPCC material defined in the Japanese Industrial Standard (JIS) G3141.

Furthermore, the sample K20 has a sealed portion k21 along the rectangular periphery of the steel plate. The sealed portion k21 is covered by a resin masking tape or the like. A galvanized film 15*a* having the thickness of 5 μm to 8 μm is formed on one surface of the steel plate. And then, a chromate film 15*b* having the weight ratio Co/Cr of 0.1 is formed on this galvanized film 15*a*.

As shown in FIGS. 7A and 7B, the sample K20 is folded along its center line to form an angle 30° between two folded portions. The inventors have designated a bended central portion of the sample K20 as a corrosion resistance evaluation portion k22. In the drawing, the evaluation portion k22 is hatched and is 10 mm in width.

The corrosion resistance evaluation was conducted based on the salt spray test (SST) which is disclosed in the above-described Japanese Patent Application Laid-open No. 2000-252042 (corresponding to the U.S. Pat. No. 6,236,148) and is defined in JIS. The bended sample K20 shown in FIG. 7B was subjected to this salt spray test.

Figure 8:
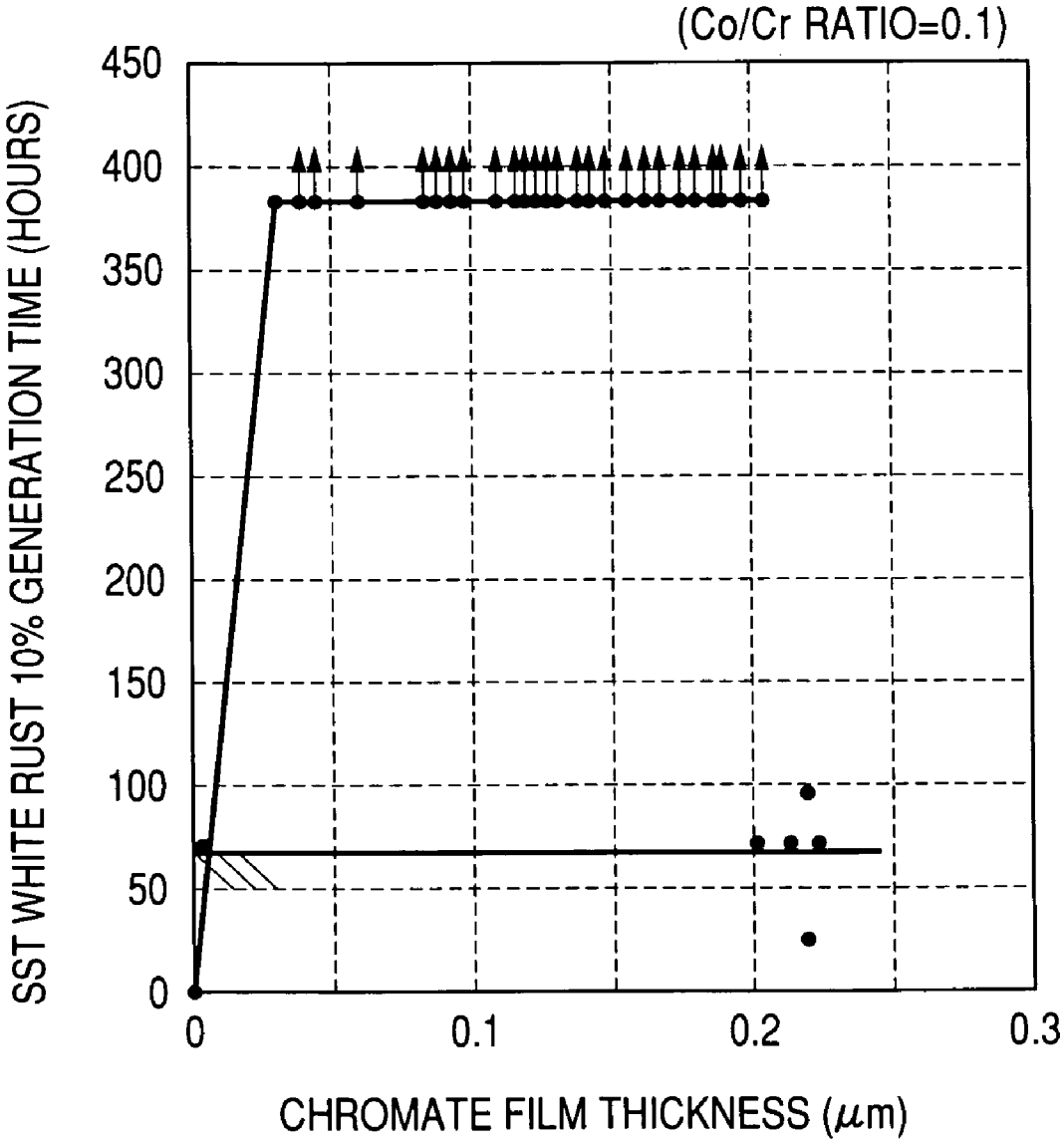
FIG. 8 is a graph showing the result of inspections for obtaining the relationship between the chromate film thickness and the SST white rust 10% generation time.

According to this corrosion resistance evaluation, the inventors have checked the time required for the corrosion resistance evaluation portion k22 to turn into white rust by 10% in area. This time is referred to as SST white rust 10% generation time. FIG. 8 is a graph showing check results with respect to the SST white rust 10% generation time in relation to the film thickness which the inventors have variously changed for evaluation.

FIG. 8 is a graph showing the relationship between the chromate film thickness (μm in units) and the SST white rust 10% generation time (hours in units). When the SST white rust 10% generation time is equal to or greater than 70 hours, it is possible to assure practically reliable corrosion resistance.

In general, the white rust occurs due to oxidation of zinc. When the white rust occurs, the above-described film reproduction effect is lessened. Oxidation of iron, i.e., red rust, will occur in the metallic member 10 or 12.

From the results shown in FIG. 8, it is understood that, when the film thickness of chromate film 15*b* is not less than 0.05 μm and not greater than 0.18 μm, the SST white rust 10% generation time greatly exceeds 70 hours and approaches to approximately 400 hours. Thus, it is confirmed that practically reliable corrosion resistance can be surely obtained.

When the film thickness is somewhere in the above-described range, it is possible to suppress exfoliations or cracks occurring in the film due to a bending stress or the like. Even if a defective portion appears in the protective coat 15 due to exfoliations or cracks, the above-described self-repair function will be appropriately effected and accordingly a sufficient film reproduction will be realized.

On the other hand, as shown in FIG. 8, when the film thickness of chromate film 15*b* is less than 0.05 μm or greater than 0.18 μm, the above-described film reproduction effect was not obtained sufficiently. Accordingly, it is not possible to obtain satisfactory corrosion resistance. In this manner, the inventors have confirmed the film reproduction effects of this embodiment.

Furthermore, according to the protective coat 15 of this embodiment, the metallic component contained in the chromate film 15*b* is cobalt. The weight ratio Co/Cr of cobalt elements to chromium elements contained in the chromate film 15*b* is set to be a value not smaller than 0.05 and not greater than 0.4.

The inventors have experimentally evaluated and confirmed the effects of the arrangement of the protective coat 15 according to this embodiment. The following is one example of evaluation results.

The inventors have conducted the corrosion resistance evaluation on the sample K20 shown in FIG. 6 according to the above-described evaluation method shown in FIGS. 7A and 7B.

Figure 9:
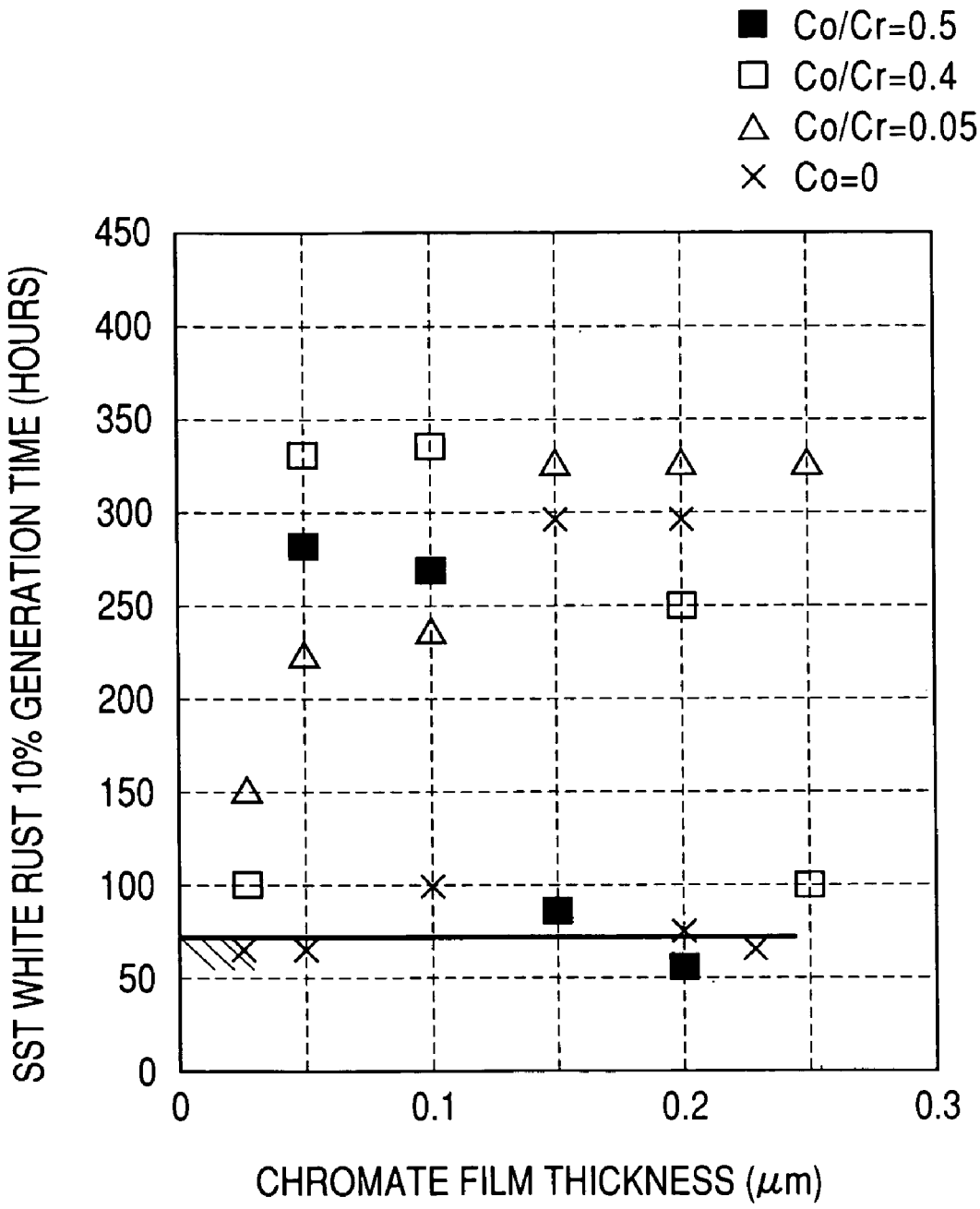
FIG. 9 is a graph showing the relationship between the chromate film thickness and the SST white rust 10% generation time in each weight ratio Co/Cr which is variously changed.

In this evaluation, the inventors have prepared several samples K20 which are differentiated in the weight ratio Co/Cr in the chromate film 15*b*. The inventors have set the weight ratio Co/Cr to each level of 0 (i.e. Co=0), 0.05, 0.4, and 0.5 and checked the SST white rust 10% generation time in each film thickness which the inventors have changed for evaluation. FIG. 9 shows evaluation results.

FIG. 9 is a graph showing the relationship between the chromate film thickness (μm in the units) and the SST white rust 10% generation time (hours in the units) in each weight ratio Co/Cr. Regarding the SST white rust 10% generation time, 70 hours is set as a reference level for obtaining the practically reliable corrosion resistance.

In FIG. 9, cross plots represent the data in the case of weight ratio Co/Cr=0, white triangular plots represent the data in the case of weight ratio Co/Cr=0.05, white square plots represent the data in the case of weight ratio Co/Cr=0.4, and black square plots represent the data in the case of weight ratio Co/Cr=0.5.

From the results shown in FIG. 9, it is understood that the SST white rust 10% generation time clears 70 hours when the film thickness of chromate film 15*b* is not less than 0.05 μm and not greater than 0.18 μm and further when the weight ratio Co/Cr is not smaller than 0.05 and not greater than 0.4. Thus, it is confirmed that practically reliable corrosion resistance can be surely obtained.

Furthermore, when the weight ratio Co/Cr is smaller than 0.05; e.g, when Co/Cr is equal to 0, the total amount of Co is too small to contribute to the film reproduction. Thus, the obtainable film reproduction effect will be insufficient. The corrosion resistance will be insufficient. This tendency is remarkable when the film thickness of chromate film 15*b* is thin as shown in FIG. 9.

On the other hand, when the weight ratio Co/Cr is larger than 0.4; i.e. Co/Cr is equal to 0.5, the total amount of Co is too large and accordingly the chromate film 15*b* becomes hard.

Furthermore, as shown in FIG. 9, when the chromate film 15*b* is thick, there is the tendency that many exfoliations or cracks appear. Accordingly, the above-described film reproduction effects will be canceled. The obtained corrosion resistance will be insufficient.

As described above, this embodiment is applicable to the spark plug S1 having the protective coat 15 including the galvanized film 15*a* formed on the surface of the metallic member 10 or 12 and the hexavalent chromium-free chromate film 15*b* successively laminated on the galvanized film 15*a*. According to this embodiment, it becomes possible to assure sufficient corrosion resistance even if the chromate film 15*b* is thinned to eliminate exfoliations or cracks occurring in the chromate film 15*b* under a bending stress or the like.

Similar effects will be obtained even when the metallic component (i.e. cobalt) contained in the chromate film 15*b* is replaced by other metallic component selected from the group consisting of as nickel, molybdenum, manganese, and lanthanoids.

As described in the foregoing description, even in a thin chromate film, there is the tendency that many exfoliations or cracks appear when the chromate film is hard. However, the chromate film 15*b* of this embodiment can surely suppress generation of these exfoliations or cracks.

In this respect, the inventors of this invention have evaluated the hardness of chromate film 15*b* having the characteristics according to this embodiment. In the prior art, there was no research that has focused on the hardness of a relatively thin chromate film formed on a galvanized film of a protective coat provided on a metallic member of a spark plug.

The inventors of this invention have measured the hardness of chromate film 15*b* based on the assumption that the chromate film 15*b* of this embodiment is so characterized in film hardness that the generation of exfoliations or cracks can be effectively suppressed even if the film is thinned.

In this measurement, the inventors have prepared and used a generally known nanoindenter which is capable of measuring the hardness of a film surface (i.e. film hardness).

The inventors have done the practical measurement on the chromate film 15*b* according to this embodiment which has the film thickness not smaller than 0.05 μm and not greater than 0.18 μm and contains cobalt, as the metallic component, by the weight ratio Co/Cr not smaller than 0.05 and not greater than 0.4. The measurement results have revealed that, when the film thickness and the weight ratio are in the above-described ranges, the film hardness of chromate film 15*b* remains at substantially the same value regardless of the film thickness and the weight ratio.

Figure 10:
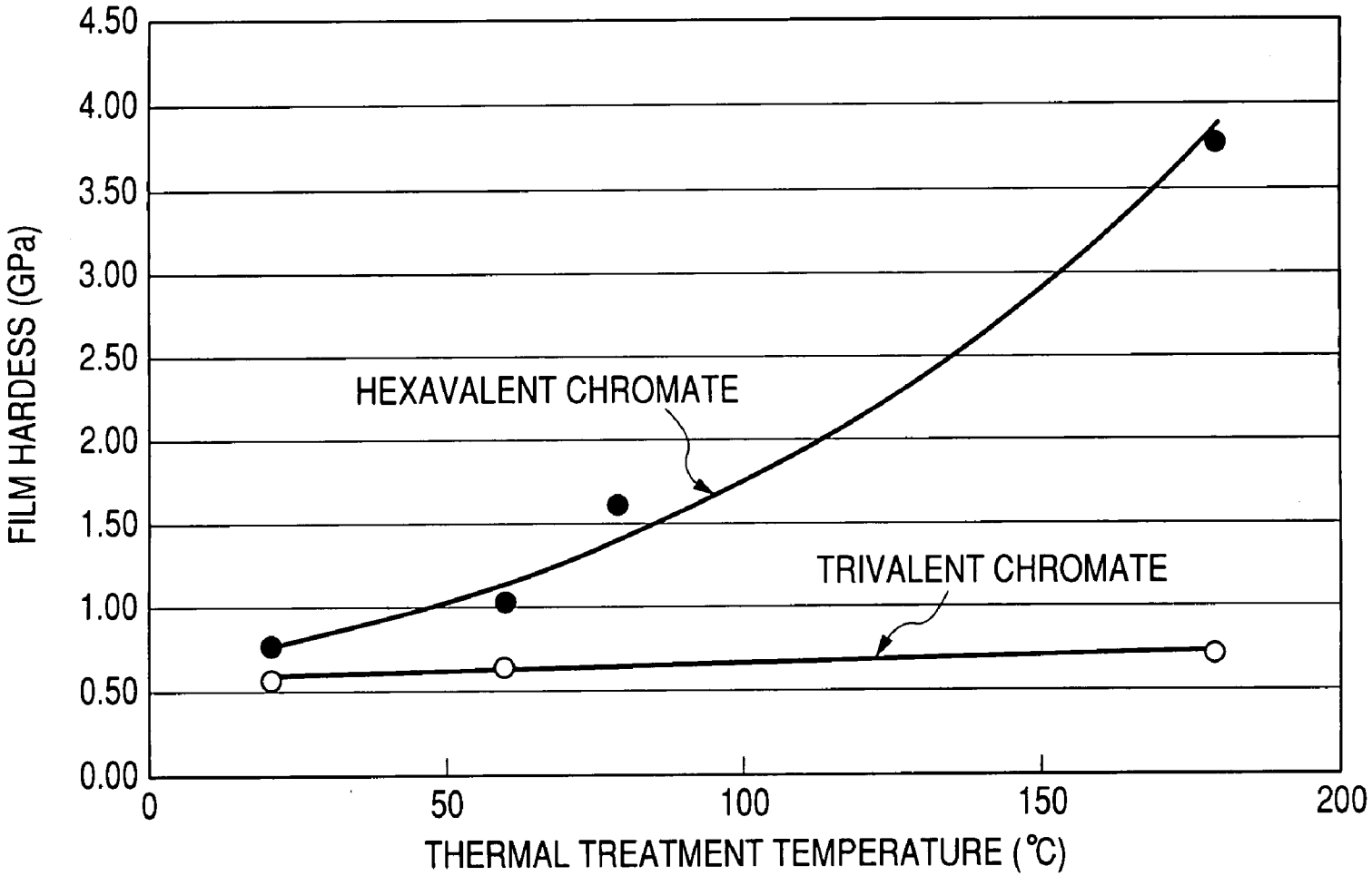
FIG. 10 is a graph showing the relationship between the thermal treatment temperature for a chromate film and the film hardness measured by a nanoindenter.

Furthermore, the inventors have prepared a conventional chromate film containing hexavalent chromium as a comparative example and measured the film hardness of this conventional chromate film. The thermal treatment temperature for the chromate film was changed during the film measurement. FIG. 10 shows the measurement results.

FIG. 10 is a graph showing the measured relationship between the thermal treatment temperature (° C. in the units) for the chromate film and the film hardness (GPa in the units). In FIG. 10, white plots represent the data of "trivalent chromate" corresponding to the chromate film 15*b* according to this embodiment while black plots represent the data of "hexavalent chromate" corresponding to the comparative chromate film (i.e. conventional chromate film).

From the results shown in FIG. 10, it is understood that the chromate film 15*b* of this embodiment is small in film hardness, i.e. soft, compared with the conventional chromate film. Especially, the difference in film hardness between this embodiment and the conventional example increases when the drying treatment temperature increases.

More specifically, the chromate film 15*b* according to this embodiment has the film hardness equal to or less than 1 GPa at a room temperature. The chromate film 15*b* according to this embodiment can assure sufficient corrosion resistance. Furthermore, as shown in FIG. 10, the chromate film 15*b* according to this embodiment has the film hardness equal to or less than 1 GPa in the range from the room temperature to 180° C.

Based on the results shown in FIG. 10, it can be concluded that this embodiment provides the spark plug S1 including the metallic housing 10, the insulator 20 fixed in the metallic housing 10, the center electrode 30 fixed in the insulator 20, the ground electrode 40 opposed to the center electrode 30 via the spark discharge gap 50, and the protective coat 15 formed on the surface of metallic member 10 or 12. The protective coat 15 includes the galvanized film 15*a* formed on the surface of this metallic member and the chromate film 15*b* successively laminated on the galvanized film 15*a*. The chromate film 15*b* is hexavalent chromium-free and contains trivalent chromium as a major component. The spark plug Si according to this embodiment is characterized in that the chromate film 15*b* has the film thickness not smaller than 0.05 μm and not greater than 0.18 μm, and the chromate film 15*b* has the film hardness equal to or less than 1 GPa at the room temperature.

According to the above-described spark plug S1, the chromate film 15*b* has the film thickness not smaller than 0.05 μm and not greater than 0.18 μm. Namely, the chromate film 15*b* according to this embodiment is thin compared with the conventional chromate film. Furthermore, the chromate film 15*b* has the film hardness equal to or less than 1 GPa at the room temperature. Namely, the chromate film 15*b* according to this embodiment is sufficiently soft. Accordingly, this embodiment can suppress exfoliations or cracks occurring in the film under a bending stress or the like.

As apparent from the above-described spark plug S1, this embodiment is applicable to the spark plug having the protective coat 15 which includes the galvanized film 15*a* formed on the surface of the metallic member 10 or 12 and the hexavalent chromium-free chromate film 15*b* successively laminated on the galvanized film 15*a*. According to this spark plug, it becomes possible to assure sufficient corrosion resistance even if the chromate film 15*b* is thinned to eliminate exfoliations or cracks occurring in the chromate film 15*b* under a bending stress or the like.

Furthermore, in the spark plug S1 defining the above-described film hardness, it is preferable that the chromate film 15*b* has the film hardness equal to or less than 1 GPa in the temperature range from the room temperature to 180° C., as shown in FIG. 10.

More specifically, setting the film hardness of chromate film 15*b* to a value equal to or less than 1 GPa in the temperature range from the room temperature to 180° C. is preferable in assuring sufficient corrosion resistance even if the thermal treatment temperature for the chromate film 15*b* is set to a higher value.

Furthermore, the chromate film 15*b* according to this embodiment is hexavalent chromium-free and accordingly contains substantially no hexavalent chromium ($Cr^{6+}$) which is a substance giving adverse influence to the environment. Thus, it is needless to say that this embodiment is excellent in view of protection of the environment.

In general, according to a conventionally used chromate film which contains hexavalent chromium, there is the tendency that the hexavalent chromium itself is easily reduced. Accordingly, the hexavalent chromium is equivalent to cobalt in providing the self-repair function. However, usage of hexavalent chromium is now restricted from the view point of protection of the environment. The hexavalent chromium-free, trivalent chromate film cannot provide the self-repair function (i.e. film reproduction effect) to be brought by the hexavalent chromium.

Considering these factors, this embodiment realizes the self-repair function by using the chromate film containing a metallic component, such as cobalt, which has the nature of being easily reduced. The self-repair function according to this embodiment can be expected even if the film thickness is not smaller than 0.05 μm and not greater than 0.18 μm; namely, even when the chromate film is thinner than a conventional chromate film.

Furthermore, as shown in FIG. 10, the chromate film containing hexavalent chromium has a large film hardness compared with the chromate film according to this embodiment. The chromate film containing hexavalent chromium tends to cause exfoliations or cracks. The film hardness of this chromate film is a parameter having been not conventionally used.

From this point, the chromate film according to this embodiment is characterized in the film hardness. The chromate film according to this embodiment can suppress exfoliations or cracks even if the film is thinned, and can enhance the corrosion resistance.

OTHER EMBODIMENTS

According to the above-described embodiment, the chromate film 15*b* is formed on the surfaces of metallic housing 10 and gasket 12 each serving as a metallic member. Furthermore, the chromate film 15*b* according to the above-described embodiment has the film thickness not smaller than 0.05 μm and not greater than 0.18 μm and contains the metallic component which is robust against oxidation compared with zinc. However, it is also preferable that only the chromate film formed on the metallic housing 10 has the above-described arrangement. Alternatively, it is preferable that only the chromate film formed on the gasket 12 has the above-described arrangement.

Especially, the gasket 12 is subjected to a large bending stress due to its structural characteristics and accordingly encounters with the problem of exfoliations or cracks. In view of the above, employing the chromate film arrangement according to the above-described embodiment is effective for the gasket 12.

Furthermore, according to the above-described embodiment, there is a ring 13 or a packing 14 intervening between the metallic housing 10 and the insulator 20. Although not shown in the drawings, the above-described protective coat 15 can be formed on the surface of the ring 13 or the packing 14. It is therefore preferable that the chromate film of the protective coat 15 formed on the ring 13 or the packing 14 has the film thickness not smaller than 0.05 μm and not greater than 0.18 μm and contains a metallic component which is robust against oxidation compared with zinc.

The things applied to these chromate films are similarly applicable to the above-described arrangement defining the film hardness.

More specifically, it is preferable to employ the arrangement of chromate film 15*b* for only one of the chromate film formed on the metallic housing 10 or the chromate film formed on the gasket 12. In this case, the chromate film 15*b* has the film thickness not smaller than 0.05 μm and not greater than 0.18 μm and the film hardness is equal to or less than 1 GPa at a room temperature (preferably in the temperature range from the room temperature to 180° C.). Furthermore, this arrangement can be employed for the chromate film formed on ring 13 or on the packing 14.

As described in the foregoing description, the present invention is applicable to a spark plug having a protective coat including a galvanized film formed on a surface of a metallic member and a hexavalent chromium-free chromate film successively laminated on the galvanized film. And, the present invention is characterized in that the thickness, contents, and hardness of the chromate film are regulated appropriately. The rest of structural features of the spark plug can be arbitrarily changed or modified.

For example, the galvanized film of the present invention should be interpreted to include all of a tin-zinc alloy plated film, a zinc-nickel alloy plated film, a zinc-iron alloy plated film, a zinc-cobalt alloy plated film, and a zinc-cobalt-iron alloy plated film.

What is claimed is:

1. A spark plug comprising:

a metallic housing carrying thereon a metallic member;

an insulator fixed in said metallic housing;

a center electrode fixed in said insulator;

a ground electrode opposed to said center electrode via a spark discharge gap; and a protective coat formed on a part of a surface of at least one of said metallic housing and said metallic member, said protective coat including a galvanized film formed on said surface of said at least one of said metallic housing and said metallic member and a chromate film successively formed on said galvanized film, wherein said chromate film is hexavalent chromium-free and contains trivalent chromium as a major component, wherein said chromate film has a film thickness not smaller than 0.05 μm and not greater than 0.18 μm, and said chromate film contains cobalt and chromium with a weight ratio Co/Cr not smaller than 0.05 and not greater than 0.4, wherein said weight ratio Co/Cr is a weight ratio of cobalt elements to chromium elements contained in said chromate film.

2. The spark plug in accordance with claim 1, wherein said metallic member is a gasket provided around an outer surface of said metallic housing.

3. The spark plug in accordance with claim 1, wherein said protective coat is formed on said metallic housing.

4. A spark plug comprising:

a metallic housing;

an insulator fixed in said metallic housing;

a center electrode fixed in said insulator;

a ground electrode opposed to said center electrode via a spark discharge gap, and a protective coat formed on a surface of a metallic member, said protective coat including a galvanized film formed on said surface of said metallic member and a chromate film successively laminated on said galvanized film, wherein said chromate film is hexavalent chromium-free and contains trivalent chromium as a major component, wherein said chromate film has a film thickness not smaller than 0.05 μm and not greater than 0.18 μm, and said chromate film has a film hardness equal to or less than 1 GPa at a room temperature, wherein said chromate film contains cobalt and chromium with a weight ratio of Co/Cr not smaller than 0.05 and not greater than 0.4, wherein said weight ratio Co/Cr is a weight ratio of cobalt elements to chromium elements contained in said chromate film, whereby when the protective coat is damaged, there is a elution of Co on the surface of the chromate film and a resultant formation of a film of cobalt hydroxide on the chromate film, thereby providing a self-repair function.

5. The spark plug in accordance with claim 4, wherein said chromate film has the film hardness equal to or less than 1 GPa in the temperature range from the room temperature to 180° C.

6. The spark plug in accordance with claim 4, wherein said metallic member is a gasket provided around an outer surface of said metallic housing.

7. The spark plug in accordance with claim 4, wherein said metallic member is said metallic housing.

8. A spark plug comprising:

a metallic housing carrying thereon a metallic member;

an insulator fixed in said metallic housing;

a center electrode fixed in said insulator;

a ground electrode opposed to said center electrode via a spark discharge gap; and a protective coat formed on a surface of at least one of said metallic housing and said metallic member, said protective coat including a galvanized film formed on said surface of said at least one of said metallic housing and said metallic member and a chromate film successively formed on said galvanized film, wherein said chromate film is hexavalent chromium-free and contains trivalent chromium as a major component, said chromate film has a film thickness not smaller than 0.05 μm and not greater than 0.18 μm, said chromate film contains cobalt and chromium with a Co/Cr ratio in a range from 0.05 to 0.4, and said chromate film has a film hardness equal to or less than 1 GPa at room temperature.

* * * * *